US010011410B2

(12) United States Patent
Fay

(10) Patent No.: US 10,011,410 B2
(45) Date of Patent: Jul. 3, 2018

(54) FLEXIBLE CONTAINER

(71) Applicant: MAVERICK INTERNATIONAL (PTY) LTD, Cape Town (ZA)

(72) Inventor: Derek Martin Fay, Cape Town (ZA)

(73) Assignee: MAVERICK INTERNATIONAL (PTY) LTD, Cape Town (ZA)

( * ) Notice: Subject to any disclaimer, the term of this patent is extended or adjusted under 35 U.S.C. 154(b) by 81 days.

(21) Appl. No.: 14/894,802

(22) PCT Filed: May 9, 2014

(86) PCT No.: PCT/IB2014/061316
§ 371 (c)(1),
(2) Date: Nov. 30, 2015

(87) PCT Pub. No.: WO2014/195813
PCT Pub. Date: Dec. 11, 2014

(65) Prior Publication Data

US 2016/0107813 A1 Apr. 21, 2016

(30) Foreign Application Priority Data

Jun. 4, 2013 (ZA) ..... 2013/04094

(51) Int. Cl.
*B65D 75/00* (2006.01)
*B65D 75/48* (2006.01)
(Continued)

(52) U.S. Cl.
CPC ..... *B65D 75/008* (2013.01); *B65D 33/004* (2013.01); *B65D 75/42* (2013.01);
(Continued)

(58) Field of Classification Search
USPC ..... 206/521, 216, 457; 383/120, 907
See application file for complete search history.

(56) References Cited

U.S. PATENT DOCUMENTS 4,652,253 A * 3/1987 Benoit ..... B31B 70/00 493/195
4,655,737 A * 4/1987 Benoit ..... B31B 70/00 493/194

(Continued)

FOREIGN PATENT DOCUMENTS

CA 671804 10/1963

OTHER PUBLICATIONS

International Search Report for PCT/IB2014/061316 dated Aug. 25, 2014.

(Continued)

*Primary Examiner* — Jacob K Ackun
(74) *Attorney, Agent, or Firm* — Stephen J. Weyer, Esq.; Stites & Harbison, PLLC

(57) ABSTRACT

The invention discloses a flexible container sleeve structure, which includes an elongated sleeve defining in series containers and having front and back panels joined to each other along their elongated sides; a first gusset formation provided between the front and back panels forming a base; a second gusset formation provided between the front and back panels forming a top; and a curvature provided in the sides of the front and back panels. The containers being defined by the front and back panels and the gusset formations. The front panel may be imprinted with a graphic of a wine barrel or beer keg. The curvature is convexly curved from the top to the base, thereby adapted to assist in creating the impression of a barrel or keg.

4 Claims, 4 Drawing Sheets

(51) Int. Cl.

| | |
|---|---|
| ***B65D 75/52*** | (2006.01) |
| ***B65D 75/56*** | (2006.01) |
| ***B65D 75/42*** | (2006.01) |
| ***B65D 33/00*** | (2006.01) |
| *B67D 1/00* | (2006.01) |

(52) U.S. Cl.
CPC ..... *B65D 75/48* (2013.01); *B65D 75/527* (2013.01); *B65D 75/56* (2013.01); *B67D 2001/009* (2013.01)

(56) References Cited

U.S. PATENT DOCUMENTS 4,810,109 A * 3/1989 Castel ..... B65D 75/008 383/104
6,397,560 B1 * 6/2002 Weder ..... B65D 31/00 150/154
7,458,195 B2 * 12/2008 Bezek ..... B65B 9/20 493/254
2006/0285775 A1 * 12/2006 Fukuizumi ..... B65D 75/42 383/37
2007/0011992 A1 1/2007 Hefner et al.
2008/0245799 A1 * 10/2008 Anderson ..... B65D 77/06 220/495.06
2010/0069212 A1 * 3/2010 Chaturvedi ..... B31B 70/00 493/214
2011/0305407 A1 * 12/2011 Gum ..... B65D 33/10 383/11
2013/0139473 A1 * 6/2013 Beer ..... B65D 31/10 53/452
2013/0195382 A1 * 8/2013 Murray ..... B65D 75/008 383/10
2013/0259406 A1 * 10/2013 Fisher ..... B65D 33/165 383/70
2014/0112599 A1 * 4/2014 Martin ..... B65D 33/10 383/10
2015/0052857 A1 * 2/2015 Hefner ..... B65B 1/02 53/551

OTHER PUBLICATIONS

Written Opinion of the International Searching Authority for PCT/IB2014/061316 dated Aug. 25, 2014.

* cited by examiner

FLEXIBLE CONTAINER

FIELD OF INVENTION

The present invention relates to a flexible container.

More particularly, the present invention relates to a flexible container and a method for manufacturing such containers, the flexible container being adapted to create the appearance of a beer keg or wine barrel.

BACKGROUND TO INVENTION

Flexible containers of the stand-up pouch variety are becoming increasingly widely used for containing beverages, particularly because they are relatively cheap to manufacture and are compact for transportation purposes. In contrast to glass and tin cans, stand-up pouches do not add significantly to the weight of the goods that they contain, especially when the goods are sold in bulk. For this reason wine is already sold in bulk containers in a bag-in-the-box form, where the bag is a pouch but not necessarily a stand-up pouch.

People prefer buying bulk containers as party-packs for entertaining. However, the sterile look of regular pouches or bag-in-box pouches is not aesthetically appealing and, thus to improve the appearance, and particularly when supplying beer or wine, people tend to purchase or rent miniature wooden kegs that normally contain 3 l, 5 l or 10 l of the goods. These kegs have the drawback of again adding to the weight of the goods making transportation to the event more difficult and cumbersome. Furthermore, the kegs normally remain the property of the filling businesses and are merely rented out for the event, which requires that the kegs need to be returned after the event is finished so as to obtain refund of a deposit paid.

It is an object of the invention to suggest a flexible container and a method for manufacturing thereof, which will assist in overcoming these problems.

SUMMARY OF INVENTION

According to the invention, there is provided a flexible container sleeve structure, which includes an elongated sleeve defining in series containers and having (g) front and back panels joined to each other along their elongated sides;

(h) a first gusset formation provided between the front and back panels forming a base;

(i) a second gusset formation provided between the front and back panels forming a top;

(j) a curvature provided in the sides of the front and back panels;

(k) the containers being defined by the front and back panels and the gusset formations; and (l) suitably spaced apart transverse separation lines on the front and back panels for separating individual containers.

The front panel may be imprinted with a graphic of a wine barrel or beer keg.

The curvature may be convexly curved from the top to the base, being adapted to assist in creating the appearance of a barrel or keg.

The curvature may be formed by chamfering the sides towards the top and base.

The chamfering may extend across the width of the first and second gusset formations.

The structure may include a carrying handle provided at its top extending over the second gusset formation.

Also according to the invention, a method of manufacturing a flexible container, which includes the steps (f) of forming a flexible container sleeve structure including an elongated sleeve defining in series containers between the front and back panels;

(g) of forming an elongated sleeve having a front panel and a back panel with opposite sides;

(h) of forming first and second elongated gusset formations along each of the opposite sides between the front and back panels;

(i) of partially sealing areas of the front and back panels to each other and sealing areas of the gusset formations to the front and back panels so as to define discrete chambers for the containers within the sleeve; and (j) of cutting consecutive opposite aligned slots into the sleeve along its length within the sealed areas, wherein the slots extend from the opposite edges fully across the first and second gusset formations.

The method may include the step of providing a perforation through the sealed areas between the opposite aligned slots, being adapted to permit separation of the discrete chambers to form a flexible container.

The method may include the step of imprinting repetitive images of a graphic, such as a wine barrel or beer keg, onto the sleeve.

The invention also extends to a flexible container sleeve, and to a flexible container.

BRIEF DESCRIPTION OF DRAWINGS

The invention will now be described by way of example with reference to the accompanying schematic drawings.

In the drawings there is shown in.

DETAILED DESCRIPTION OF DRAWINGS

Figure 1:
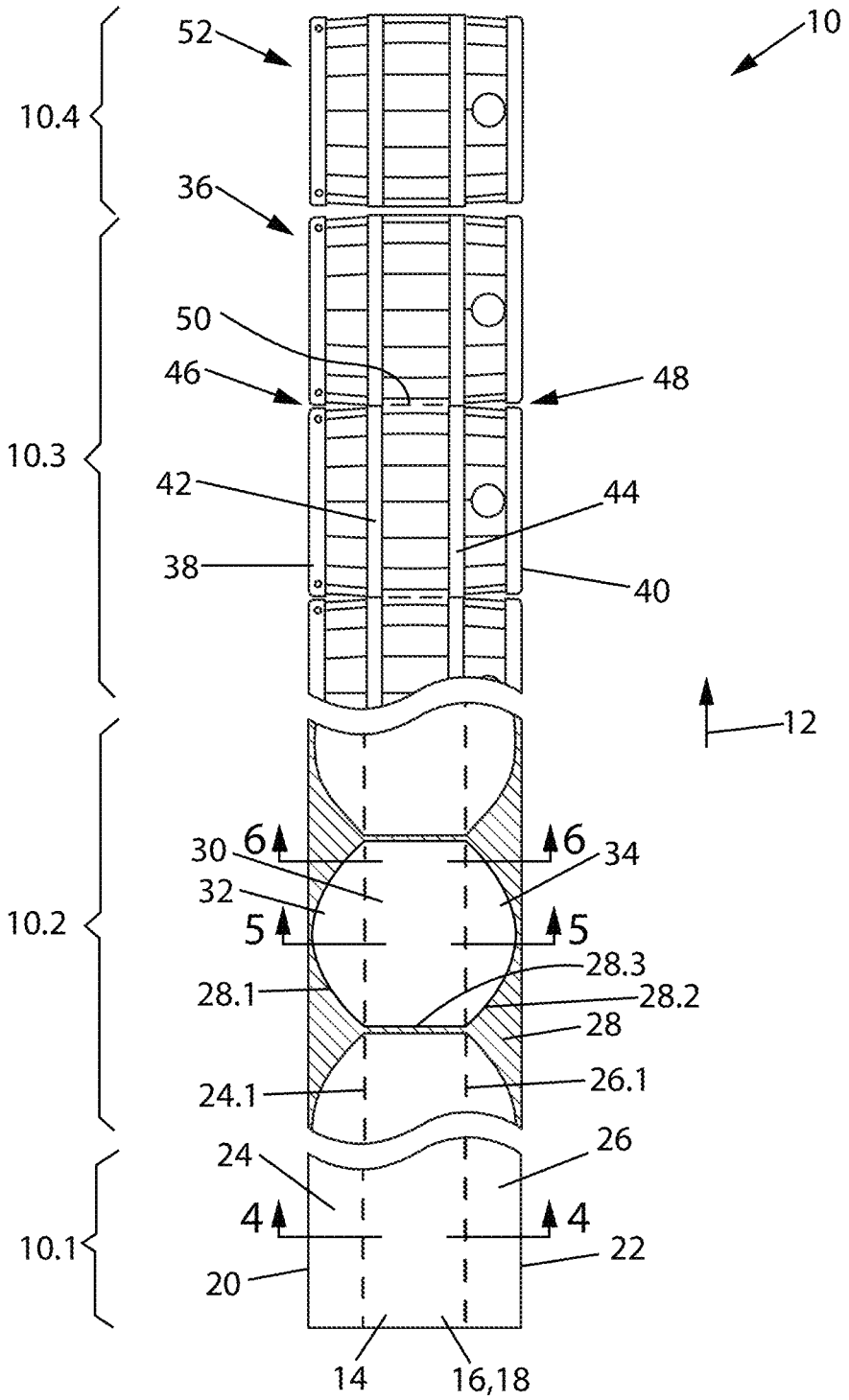
FIG. 1: A front view of a sleeve for a container forming production line for manufacturing flexible containers according to the invention.

Referring to FIG. 1 of the drawings, there is shown a container forming line, generally indicated by reference numeral 10. The line 10 is intended for manufacturing flexible containers in accordance with the invention as will be explained below. During production the line 10 is advanced in the direction of arrow 12 through four stages as described hereafter.

Figure 4:
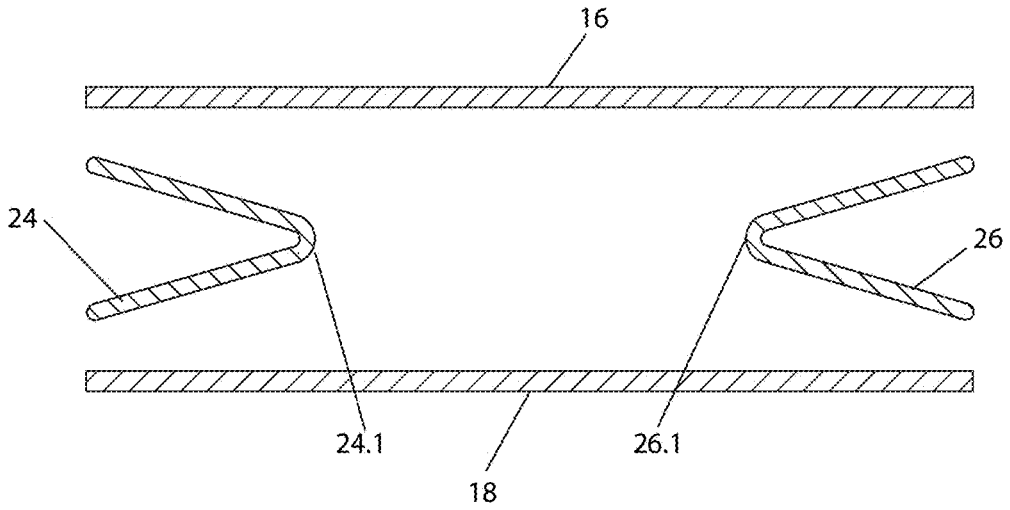
FIG. 4: A cross-sectional view of the sleeve of FIG. 1 taken at the line 4-4 of FIG. 1.

The container forming line 10 passes through a first stage 10.1 into which is fed a continuous elongate sleeve 14 with front and back panels 16,18 that lie against each other and having opposite elongated edges 20,22. As shown in FIG. 1 and FIG. 4, opposite folded elongated V-shaped gusset inserts 24,26 are located between of the panels 16,18 respectively along each of the edges 20,22 and with their free ends arranged along and facing the edges 20,22. The dashed lines

24.1, 26.1 in FIG. 1 indicate the internal vertices of the folded V-shaped gussets, which lie between the panels 16,18.

In a second stage 10.2, heat sealing means (not shown) is used to heat seal the gusset inserts 24,26 to the panels 16,18, in the area indicated by the hatched area 28.

Figure 5:
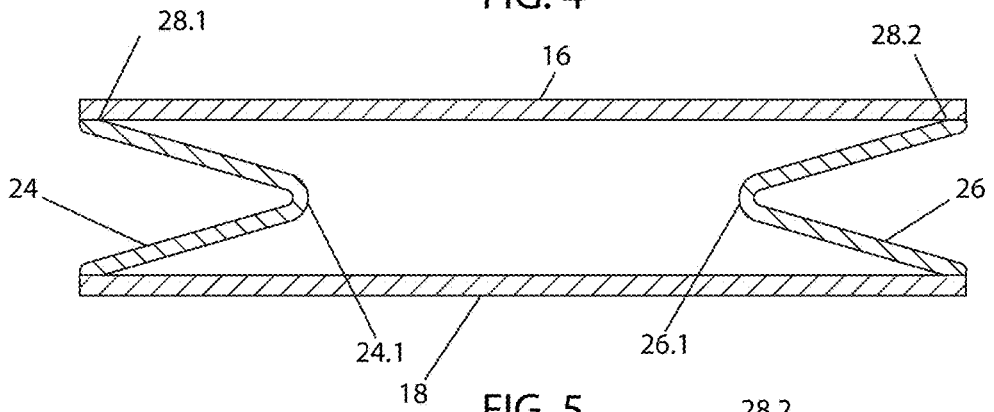
FIG. 5: A cross-sectional view of the sleeve of FIG. 1 taken at the line 5-5 of FIG. 1.
Figure 6:
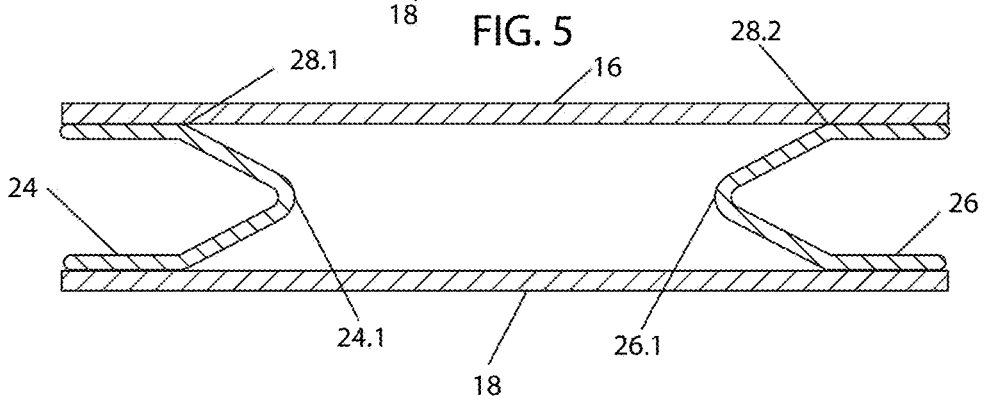
FIG. 6: A cross-sectional view of the sleeve of FIG. 1 taken at the line 6-6 of FIG. 1.

The edges 20, 22 have an inverse arcuate wavelike formation 28.1, 28.2 as shown in FIG. 1, FIG. 5, and FIG. 6, with transverse bar lines 28.3 extending perpendicularly across the sleeve 14 between crests of the wavelike formation 28.1, 28.2 defining discrete chambers 30 being formed sequentially within the sleeve 14. Each chamber 30 has internal concave bulges 32,34 by means of the gusset inserts 24,26 facing the edges 20,22.

Due to the double layer of panels 16,18, the sleeve 14 has a double wall thickness between the gusset inserts 24,26, i.e. between line 24.1 and line 26.1, whereas the sleeve 14 has a quadruple wall thickness across the gusset inserts 24,26, i.e. between the line 24.1 and the edge 20 as well as between the line 26.1 and the edge 22.

In a third stage 10.3, the front panel 16 is imprinted with a suitable graphic over each of the chambers 30, preferably having the appearance of a wine barrel or beer keg 36 with images of wooden slats with transverse metal bands. Each of these kegs 36 is later adapted to be separated from the sleeve 14 to form a flexible container 52.

Figure 2:
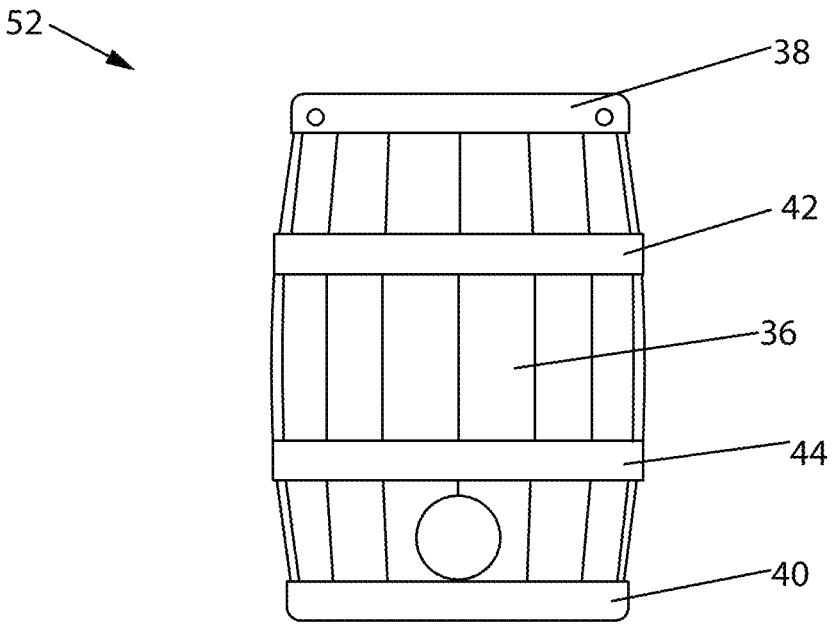
FIG. 2: A front view of a single flexible container, shown after filling and separation from the sleeve.
Figure 3:
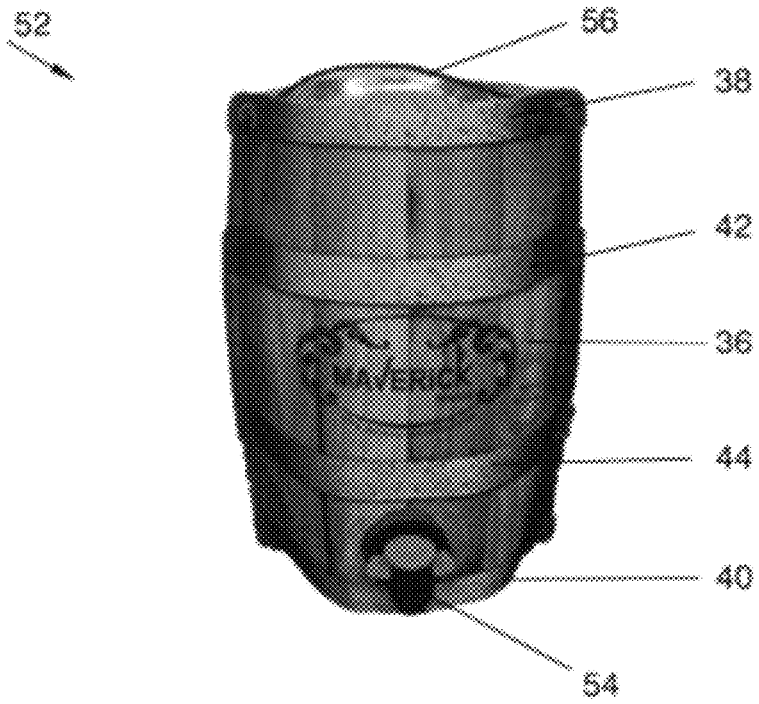
FIG. 3: A view of a filled and imprinted flexible container separated from the sleeve.

A rough schematic outline of such a flexible container with keg image 36 is shown in FIG. 2, whereas a photo print version thereof is shown in FIG. 3.

Preferably the keg 36 includes the image of four metal bands 38 . . . 44 being arranged substantially parallel to each other, with the two outer bands 38,40 being adjacent to the edges 20,22 and with the two inner bands 42,44 being located adjacent to and between the gusset vertices 24.1, 26.1.

The third stage 10.3 further involves a die cutting unit (not shown), which stamps out V-shaped slots 46,48 from the sleeve 14. The slots 46,48 are aligned with each other and extend inwardly perpendicularly from the edges 20,22 up to the gusset vertices 24.1,26.1 so as to cut fully through the sleeve 14 where it has a quadruple wall thickness. The die cutting unit further stamps a separation perforation line 50 linearly through the bars 28.3 between the slots 46,48 where the sleeve 14 has a double wall thickness so that individual kegs 36 can later be separated from each other.

The V-shape of the slots 46,48 serves as a further aesthetic purpose for creating a rounded appearance of the keg 36. As such the slots 46,48 can have an arrowhead shape whereby a part of the sleeve 14 under the image of the outer bands 38,40 extends into the opening of the slots 46,48, thereby to create the impression that the bands 38,40 stand proud of the wooden slats.

Finally, in a fourth stage 10.4 each keg 36 can be separated from the sleeve 14 along the perforation line 50 to form an individual flexible container 52.

The containers 52, before separation, are shown lying horizontally (FIG. 1). After separation the containers 52 are placed onto their bottom band 40 as shown in FIGS. 2 and 3.

Advantageously, the sleeve 14 will either be rolled up for transportation to a filling line of a filling plant or the sleeve 14 can be directly fed to a filling line from the third stage 10.3 prior to separation along the perforation lines 50.

Having the flexible containers 52 joined to each other assists in feeding the sleeve 14 through the filling plant and improves the stability of the flexible container 52 while being filled. After filling is complete, the flexible containers 52 are then separated along the perforation lines 50.

Once filled with a beverage, e.g. wine or beer, the beverage in the flexible container 52 expands the panels 16,18 and gussets 24,26 so that the container 52 takes on a substantially cylindrical shape in the form of a stand up pouch as shown in FIG. 3. A suitable tap fitting 54 is provided on the panel 16 for dispensing the beverage from the flexible container 52, while a carrying handle 56 can also be provided.

When seen from the front, the flexible container 52 takes on the appearance of a proper beer keg due to the graphic and the curvatures formed in its side walls due to the shape of the slots 46,48 cut into the sleeve 14.

The invention claimed is:

1. A flexible container sleeve structure, which includes an elongated sleeve defining a series of containers, the flexible container sleeve comprising:

front and back panels each having opposite elongated edges;

a first gusset located between the front and back panels, the first gusset connected to one of the elongated edges of the front panel and one of the elongated edges of the back panel to form a base; and a second gusset located between the front and back panels, the second gusset connected to the other of the elongated edges of the front panel and the other of the elongated edges of the back panel to form a top;

wherein, the containers are defined by the front panel, the back panel, the first gusset, and the second gusset;

wherein a slot is stamped out of the top across a width of the second gusset and a slot is stamped out of the base across a width of the first gusset such that each container has a curvature provided in the side of the container; and wherein suitably spaced apart transverse separation lines are stamped through the front and back panels for separating individual containers.

2. A structure as claimed in claim 1, in which the front panel is imprinted with a graphic of a wine barrel or beer keg.

3. A structure as claimed in claim 1, in which the curvature is convexly curved from the top to the base, being adapted to assist in creating the appearance of a barrel or keg.

4. A structure as claimed in claim 1, which includes a carrying handle provided at the top extending over the second gusset.

* * * * *